US009080334B2

(12) United States Patent
Hayasaki et al.

(10) Patent No.: US 9,080,334 B2
(45) Date of Patent: Jul. 14, 2015

(54) RECYCLABLE FORMWORK

(75) Inventors: Masahiro Hayasaki, Fukuoka (JP); Shigeyuki Nishijima, Fukuoka (JP); Hideyuki Yamamoto, Fukuoka (JP)

(73) Assignee: JUST.WILL CO., LTD., Fukuoka (JP)

( * ) Notice: Subject to any disclaimer, the term of this patent is extended or adjusted under 35 U.S.C. 154(b) by 0 days.

(21) Appl. No.: 13/993,467

(22) PCT Filed: Dec. 15, 2011

(86) PCT No.: PCT/JP2011/079048
§ 371 (c)(1),
(2), (4) Date: Aug. 5, 2013

(87) PCT Pub. No.: WO2012/090716
PCT Pub. Date: Jul. 5, 2012

(65) Prior Publication Data

US 2013/0323343 A1 Dec. 5, 2013

(30) Foreign Application Priority Data

Dec. 27, 2010 (JP) ..... 2010-290650

(51) Int. Cl.

| | |
|---|---|
| ***E04G 9/05*** | (2006.01) |
| ***E04G 9/00*** | (2006.01) |
| ***E04G 9/02*** | (2006.01) |
| ***E04G 9/10*** | (2006.01) |
| ***E04G 17/065*** | (2006.01) |
| ***E04G 9/04*** | (2006.01) |

(52) U.S. Cl.
CPC .. *E04G 9/00* (2013.01); *E04G 9/02* (2013.01); *E04G 9/04* (2013.01); *E04G 9/05* (2013.01); *E04G 9/10* (2013.01); *E04G 17/065* (2013.01); *E04G 2009/028* (2013.01)

(58) Field of Classification Search
CPC ..... E04G 9/00; E04G 9/05; E04G 9/10; E04G 11/08; B28B 7/00; B28B 7/0002; B28B 7/0044; B28B 7/08; B28B 7/082
USPC ..... 425/63; 264/187
See application file for complete search history.

(56) References Cited

U.S. PATENT DOCUMENTS

| | | | | |
|---|---|---|---|---|
| 4,131,405 | A * | 12/1978 | Moore | 425/143 |
| 6,247,677 | B1 * | 6/2001 | Vinet et al. | 249/189 |
| 2011/0115613 | A1 * | 5/2011 | Kaga et al. | 340/10.51 |

FOREIGN PATENT DOCUMENTS

| | | |
|---|---|---|
| JP | 1-112242 | 7/1989 |
| JP | 2000-94428 | 4/2000 |

(Continued)

OTHER PUBLICATIONS

Dewrent Abstract of KR 20080104555A.*

(Continued)

*Primary Examiner* — Jacob Thomas Minskey
(74) *Attorney, Agent, or Firm* — Wenderoth, Lind & Ponack, L.L.P.

(57) ABSTRACT

A recyclable formwork adds a new function without destroying other functions of the recyclable formwork. The recyclable formwork includes a main unit including a contact surface contacting with cast concrete, a non-contact surface parallel and opposite to the contact surface, and a plurality of ribs projecting from the non-contact surface and reinforcing the main unit. A case is housed between the plurality of ribs and fixed on the non-contact surface. A circuit is stored in the case. A highest point of the case at the side of the non-contact surface is not higher than a highest point of upper ends of the plurality of ribs.

8 Claims, 8 Drawing Sheets

(56) References Cited

FOREIGN PATENT DOCUMENTS

| | | | |
|---|---|---|---|
| JP | 2001013013 A | * | 1/2001 |
| JP | 2004-332301 | | 11/2004 |
| JP | 2008-114376 | | 5/2008 |

OTHER PUBLICATIONS

International Search Report issued Jan. 17, 2012 in corresponding International Application No. PCT/JP2011/079048.

* cited by examiner

RECYCLABLE FORMWORK

BACKGROUND OF THE INVENTION

1. Field of the Invention

The present invention relates to a recyclable formwork whose used condition can be easily known. The recyclable formwork is represented by a plastic formwork. The recyclable formwork, however, may be not only the plastic formwork but also a metal formwork, especially a formwork of aluminium, iron, or steel, as long as characteristics thereof, such as weight, price, or the like are suitable.

2. Description of the Related Art

Countermeasures against greenhouse gas represented by carbon dioxide are important subjects in which human beings should immediately aim to solve. Carbon dioxide reduction should be strongly carried out without damaging the economy. The inventors will discuss a new proposition in a field of formworks used for curing concrete.

Until now, formworks are mainly concrete panels made of tropical wood.

Instead of the concrete panels of wood, plastic formworks are developed and used. Some types of the plastic formworks can be perfectly recycled and are regarded as next-generation formworks.

There are, however, the following problems with respect to plastic formworks. First, a unit price of the plastic formworks is about five times that of concrete panels. Secondly, initial investment for the plastic formworks is extensive. Furthermore, the investment cannot be amortized in one construction site.

As for costs considering a number of repeated use times, the first number of repeated use times of the concrete panels are normally about five, and the second number of repeated use times of the plastic formworks is about fifty, that is, ten times the first number. As for costs per one time use, which is obtained by dividing the unit prices by the numbers of repeated use times, the concrete panels are almost double the plastic formworks. The plastic formworks are superior to the concrete panels with respect to not only environmental load but also the cost per one time use.

However, since there is no means for effectively managing the long use time of the plastic formworks, the plastic formworks have not been practically and widely used yet.

The formworks are brought to a construction site to be built there. Next, concrete is cast between the built formworks to be cured, the concrete is hardened and solidified, and then the formworks are released. However, curing time remarkably differs according to portions of a structure to be built, such as a wall, a beam, and a floor, or the like.

There is no technical means for managing the formworks taking the differences of curing time caused by the portions where the formworks are used into consideration. Actually, a construction supervisor of the construction site and the men use the formworks on their hunches.

In short, it is impossible to solve the above problem with conventional plastic formworks and it is necessary to add a new function to the conventional plastic formworks. Furthermore, consideration must be done such that the added new function does not spoil the other functions of the plastic formworks. A technique that satisfies such requirement has not been known yet.

[Document 1] Japanese patent application Laid-open on No. 2004-332301

OBJECTS AND SUMMARY OF THE INVENTION

An object of the present invention is to provide a recyclable formwork that can add the new function without spoiling the other functions of the recyclable formwork.

A first aspect according to the present invention provides a recyclable formwork, comprising a main unit including a contact surface contacting with cast concrete, a non-contact surface being parallel and opposite to the contact surface, and a plurality of ribs outstanding from the non-contact surface to a side opposite to the non-contact surface and reinforcing the main unit. A case is housed between the plurality of ribs and fixed on a side of the non-contact surface. A circuit is stored in the case, wherein a first highest point of the case at the side of the non-contact surface is not higher than a second highest point of upper ends of the plurality of the ribs.

This structure enables the addition of a function that cannot be realized by a simple recyclable formwork by using a function of the circuit stored in the case.

Furthermore, since the first highest point of the case is not higher than the second highest point of the upper ends of the plurality of ribs, the case does not project to the exterior of the plurality of ribs. A plurality of recyclable formwork can be heaped up as the same as normal recyclable formworks. This is because the case exists within the height of the main unit and the recyclable formwork does not incline.

When a plurality of recyclable formworks are build at a construction site, separators are provided with the plurality of recyclable formworks to determine intervals between sets of recyclable formworks facing with each other, and steel pipes are arranged to inwardly press the sets of recyclable formworks. Herein, the cases do not interfere with adhesion of the steel pipes and the sets of recyclable formworks, and concrete can be cast and cured without a hitch.

A second aspect according to the present invention as defined in the first aspect provides a recyclable formwork, wherein the circuit includes an inclination sensor for measuring inclination of the recyclable formwork.

This arrangement enables the measurement of the inclination of the recyclable formwork, thereby judging whether the recyclable formwork is held horizontally or vertically, or the like.

According to the present invention, recyclable formworks can not only be kept overlapping with each other but also be built and supported without a hitch. Furthermore, the circuit stored in the case can add a function that conventional recyclable formwork does not possess.

Figure 1:
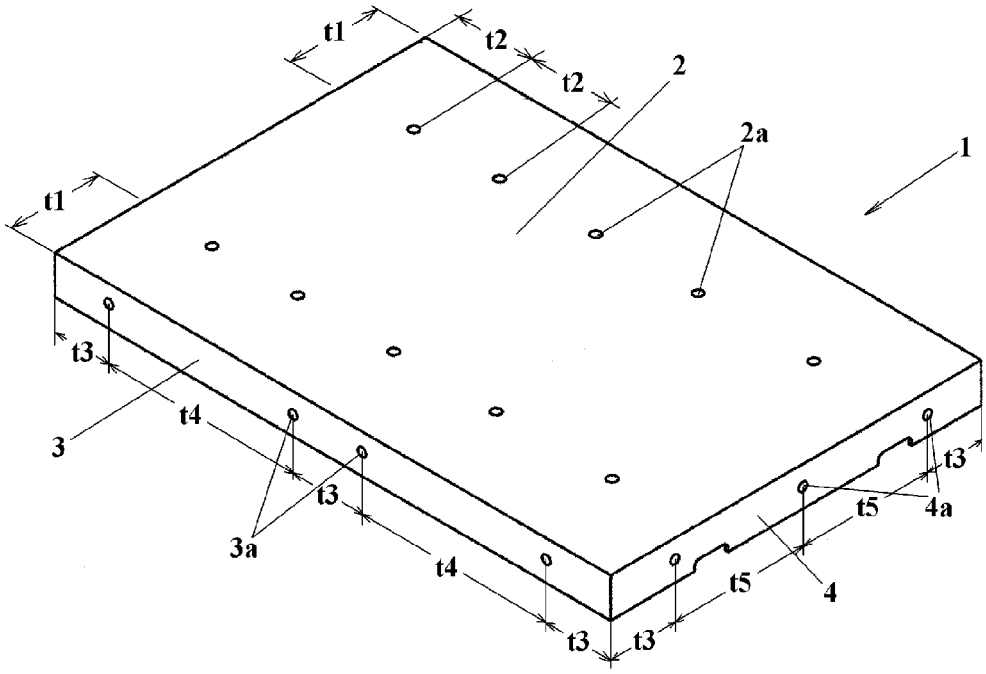
FIG. 1 is a perspective diagram showing a view of a recyclable formwork according to an embodiment of the present invention from a contact surface.

1: Main unit of recyclable formwork
1*a*: Non-contact surface
2: Contact Surface
2*a*: Separator hole
3: Long side edge rib
3*a* and 4*a*: Clip hole
4: Short side edge rib
5: Long side reinforcing rib
6: Short side reinforcing rib
7: Case
12: U-shaped clip
13: Square washer
14: Inserting hole
15: Cable
16: Surrounding wall
17: Groove
18: Separator
18*a*: Make screw part
19: Plastic cone
20: Concrete form clamp
71: Cover
72: Flange
73: Base plate
74: Substrate holder
75: First substrate
76: Inclination sensor
77: Second substrate
78: Communication circuit

DETAILED DESCRIPTION OF THE PREFERRED EMBODIMENTS

Embodiments of the present invention will now be described with reference to the drawings.

Figure 2:
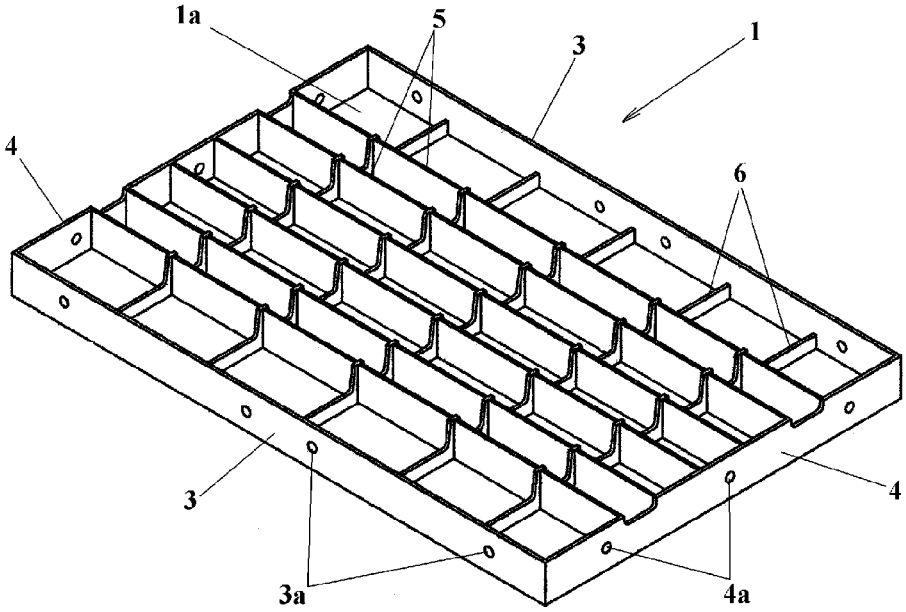
FIG. 2 and FIG. 3 are perspective diagrams showing another view of the recyclable formwork according to the embodiment of the present invention from a non-contact surface.

FIG. 1 is a perspective diagram showing a view of a recyclable formwork according to an embodiment of the present invention from a contact surface, and FIG. 2 is a perspective diagram showing another view of the recyclable formwork according to the embodiment of the present invention from a non-contact surface. Both of FIG. 1 and FIG. 2 illustrate a state where a case has not been provided yet.

Figure 3:
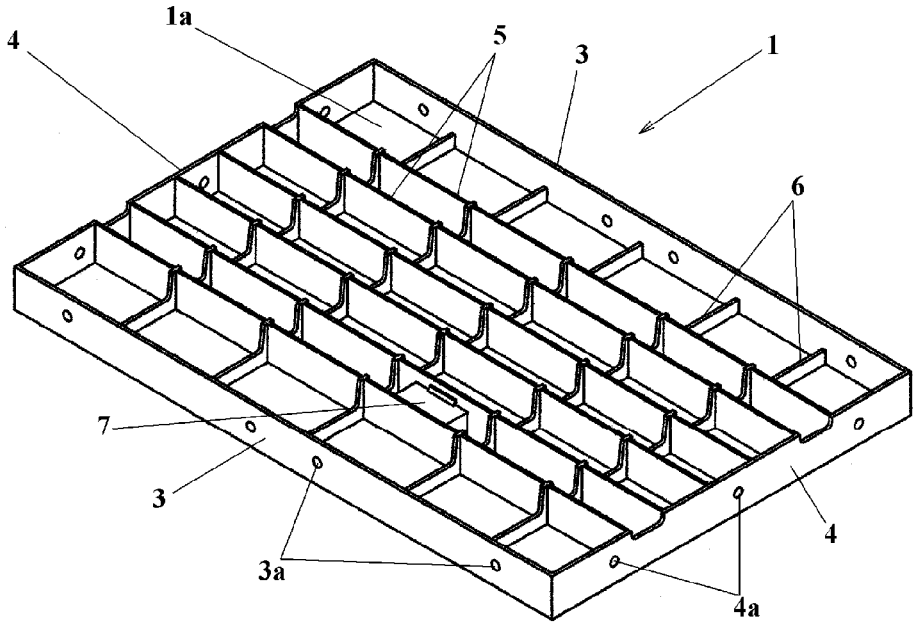

FIG. 3 is a perspective diagram showing a view of the recyclable formwork according to the embodiment of the present invention. Dissimilar to FIG. 2, FIG. 3 shows a state where the case has been provided.

As illustrated in FIG. 1, a main unit 1 of the recyclable formwork of the embodiment is formed almost in a rectangle. A plurality of separator holes 2*a* are opened in determined pitch on a contact face 2 contacting with concrete when being cast. The plurality of separator holes are formed so as to permit the insertion of separators 18 therein (see FIG. 7). The separators 18 lead from the contact surface 2 to a non-contact surface 1*a*. Preferably, the outside dimensions of the main unit 1 of the recyclable formwork may be determined based on dimensions of concrete panels. For example, a short side may be determined as 60 cm, and a long side may be determined as 90 cm. Of course, the values are merely examples, and can be changed variously.

The separator holes 2*a* are formed at a factory where the main unit 1 of the recyclable formwork is manufactured, and have very high precision. When not being inserted and used, the separator holes 2*a* should be closed with stoppers (not shown) made of resin (for example, polypropylene, or the like). It is preferable to prohibit opening holes other than the separator holes 2*a* on the construction site.

Concerning this point, field-workers often tend to make holes, using drills, in concrete panels without a hole at a construction site where the concrete panels of wood are used. Such operations not only need long time and hard labor but also cause problems with respect to precision of the positions and/or dimensions of opened holes in many cases.

When concrete panels in which holes have been made according to a certain dimension system are re-used at another construction site, the other holes according to another dimension system are further made therein and the concrete panels become hard to be used since there are too many holes. Since it is troublesome to close opened and not used holes with stoppers, concrete panels with unclosed holes may be used. Such a situation is unfavorable.

According to the embodiment, the above disadvantages are avoided. Since the recyclable formwork has short sides of 60 cm and long sides of 90 cm, intervals t1 from the long sides to the separator holes 2*a* are determined as 15 cm. When the main units 2 of recyclable formworks of FIG. 2 are horizontally arranged, the interval between separator holes of the recyclable formworks adjacent to each other becomes 30 cm.

The main units 1 of the recyclable formworks are not merely formed so as to have a shape of a simple plate. That is, long side edge ribs 3 and short side edge ribs 4 having the same height are installed downward (from the contact surface 2 to the non-contact surface 1*a*) in FIG. 1 from long sides and short sides. Clip holes 3*a* and 4*a* penetrating the thickness of the ribs 3 and 4 are opened according to a first interval t3 of 10 cm, a second interval t4 of 30 cm, and a third interval t5 of 20 cm.

Figure 4:
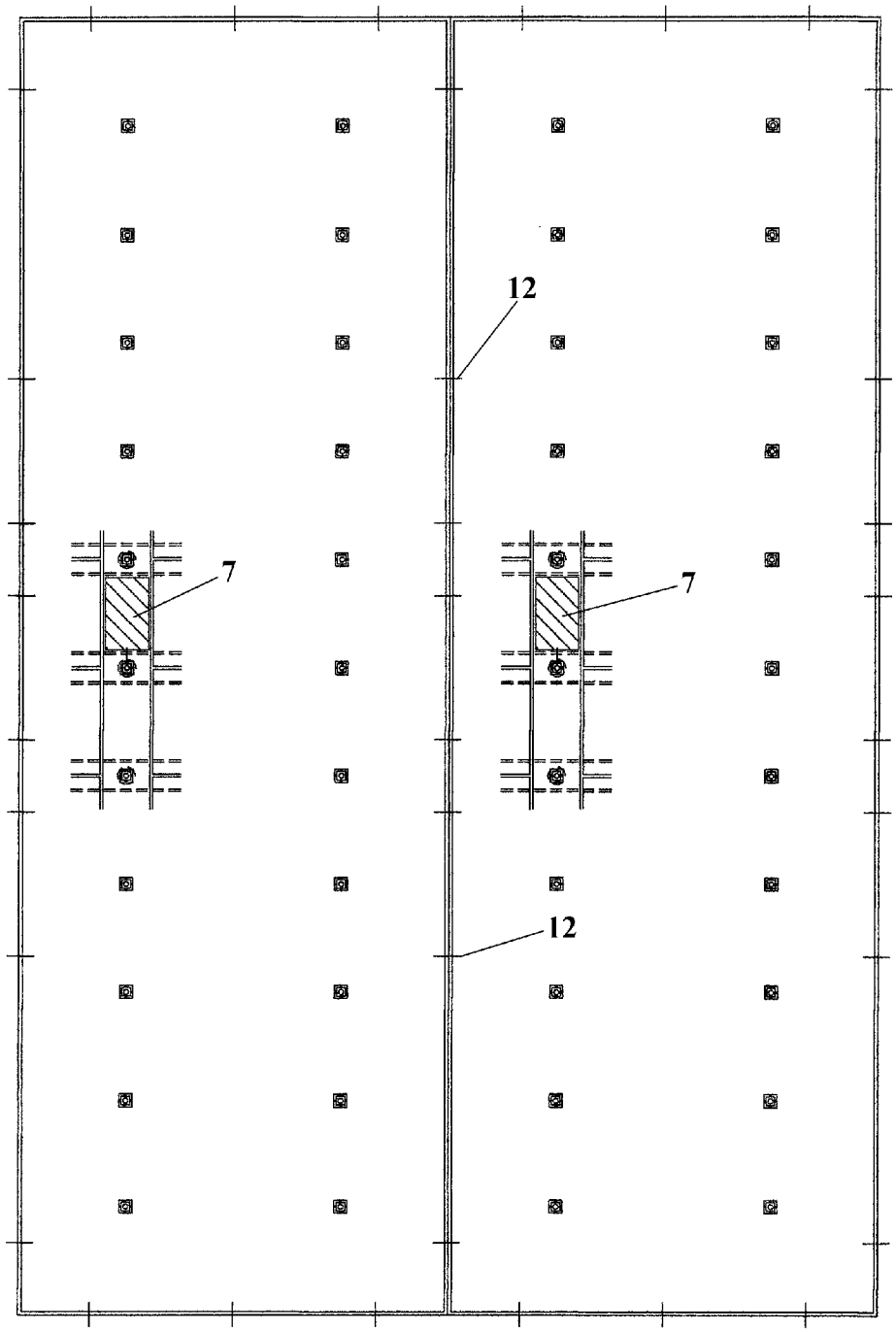
FIG. 4 is an elevation illustrating a state where two recyclable formworks are connected while long sides thereof contact with each other according to the embodiment of the present invention.

The recyclable formworks adjacent to each other can be connected when long sides or short sides of the recyclable formworks are adhered and U-shaped clips are inserted into the clip holes 3*a* and 4*a*, thereby combining the long sides or the short sides with each other from the outside using the clips (see also FIG. 4).

FIG. 2 illustrates the main unit 1 of recyclable formwork whose non-contact surface 1*a* looks upward. That is, in addition to the above-described long side edge ribs 3 and the short side edge ribs 4, a plurality of long side reinforcing ribs 5 and short side reinforcing ribs 6 each having the same maximum height as that of the long side edge ribs 3 and the short side edge ribs 4 are formed to outstand, thereby improving general strength of the main unit 1 of recyclable formwork.

As clear from FIG. 2 and FIG. 3, there is a space between the ribs. In this embodiment, a case 7 is housed and fixed in the space between the ribs.

As later mentioned in detail, a circuit is stored in the case 7. The main unit 1 of recyclable formwork contacts with cast-in-place concrete. When the temperature gets unusually high, water may be poured on the formwork to cool it down on the construction site. And, the formwork may get wet when it rains or snows. Therefore, the case 7 covers the circuit to protect it.

As for an important point, the highest point of the case 7 at the side of the non-contact surface 1*a* is not higher than the other highest point of upper ends of the ribs 3, 4, 6 and 7, and the case 7 never projects to an opposite side of the contact surface 2 than the long side edge ribs 3 and the short side edge ribs 6.

In short, the thickness of the main unit 1 of recyclable formwork does not change no matter whether the case 7 is housed thereon or not. For this reason, the main units 1 of recyclable formworks can be overlapped in the same condition as where the case 7 had not been housed yet, for example, when conveying the main units 1 of recyclable formworks with a truck, when keeping them in a stock yard, or the like.

When building the main units 1 of recyclable formworks and pushing steel pipes to the formworks to position them, sufficient pressing force can be acquired, and the steel pipes do not damage the case 7 or the circuit covered by the case 7 therein.

FIG. 4 is an elevation showing a state where long sides of two recyclable formworks according to the embodiment contact and are connected with each other. Dissimilar to the case of FIG. 1, a long side is determined as 180 cm. As explained above, adjacent main units 10 and 11 of recyclable formworks are connected to each other using U-shaped clips 12.

Even if selecting the size of FIG. 4, it is practically sufficient to provide one case 7 with one main unit of recyclable formwork. However, this is not a limitation, and the scope of the present invention also includes the situation where a plurality of cases are provided with one recyclable formwork. If not severely examining detection precision, some recyclable formworks that are not provided with cases may also be used together.

Figure 5:
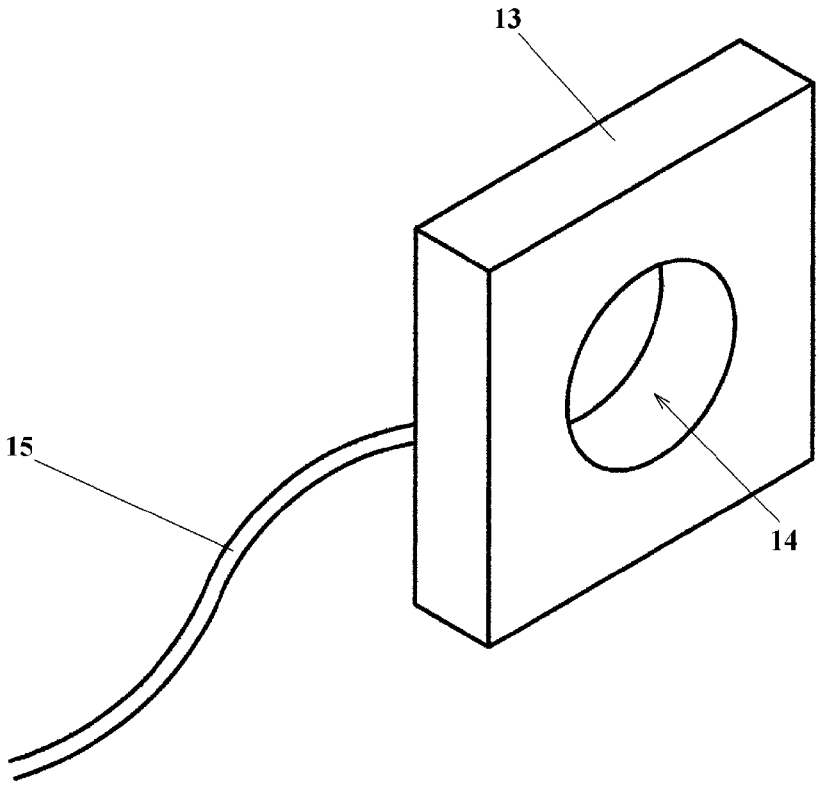
FIG. 5 is a perspective diagram showing how to handle a temperature sensor according to the embodiment of the present invention.
Figure 6:
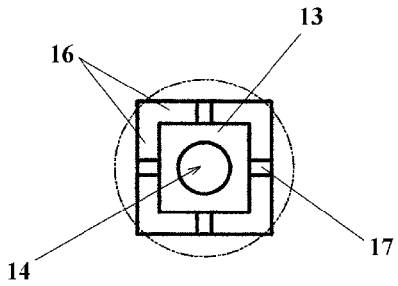
FIG. 6 is a plan of a square washer according to the embodiment of the present invention.

FIG. 5 is a perspective diagram showing how to handle a temperature sensor according to the embodiment of the present invention. In this embodiment, a thermistor is used as the temperature sensor. The thermistor (not shown) is thermally connected and united to a square washer 13.

A cable 15 is connected to an output terminal of the thermistor, and is pulled out from the square washer 13. The square washer is used in order to avoid the use of a screw thread. An inserting hole 14 having a diameter equal to or slightly greater than that of a separator 18 is opened in the center of the square washer 13, thereby also enabling the insertion of the separator 18 into the square washer 13.

Although not shown in FIG. 3, the circumference of the separator hole 2*a* is in the shape of square to form a surrounding wall 16, thereby enabling the insertion of the square washer 13 therein. Furthermore, a part of the surrounding wall 16 is cut off to enable the cable 15 to be pulled to the outside.

Figure 7:
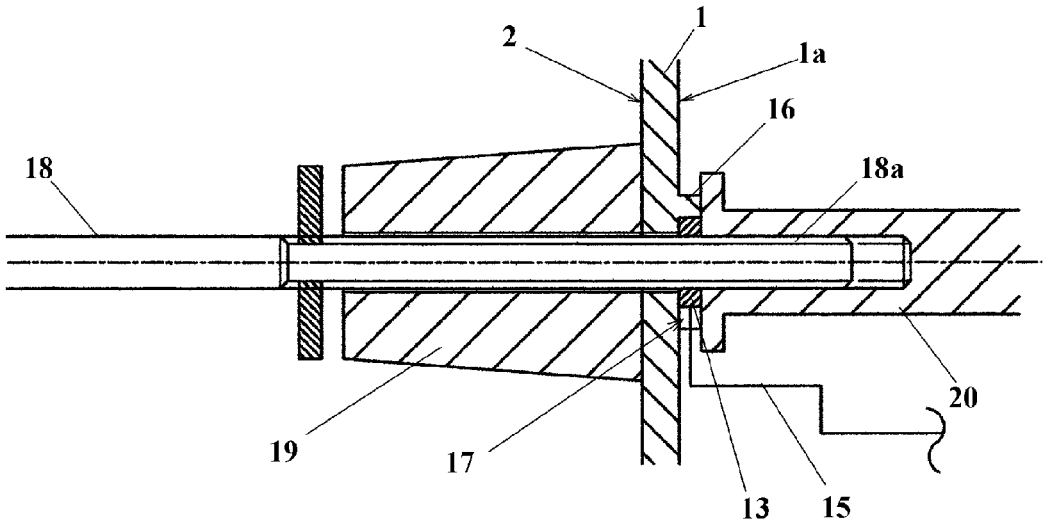
FIG. 7 is a sectional diagram showing an attachment part of a separator according to the embodiment of the present invention.

FIG. 7 is a sectional view showing an attachment part of the separator according to the embodiment of the present invention. Before a pair of recyclable formworks are supported to face to each other in a determined interval, plastic cones 19 are screwed onto male screw parts 18*a* formed at both ends of the separator 18.

And then, the male screw parts 18*a* are inserted such that the right end faces of the plastic cones 19 in FIG. 7 contact with the contact surface 2 of the main unit 1 of the recyclable formwork. As a result, the male screw parts 18*a* penetrate the separator holes 2*a* of the main unit 1 of the recyclable formwork and the inserting holes 14 of the square washers 13, and project further outside from the non-contact surface 1*a*.

End parts of clamps 20, so called "form-tie nuts", are screwed onto and fixed to projecting ends of male screw parts 18*a*.

The separators 18 physically and thermally contact with concrete (especially, center part thereof) cast between pairs of main units 1 of the recyclable formworks.

The separators 18 are made of material with high thermal conductivity (e.g. iron), and adhere to the square washers 13. Accordingly, the temperature sensor (thermistor in the embodiment) thermally contacts with the concrete via the separators 18 or the like. For this reason, the temperature sensor can directly measure the change of temperature of the internal concrete.

Next, referring to FIG. 8 and FIG. 9, attachment of the case 7 in the embodiment will now be explained. Needless to say, how to attach the case as described below is a mere example, and the scope of the present invention includes other modification of substituting well-known means such as a nail and/or a peg instead.

Figure 8:
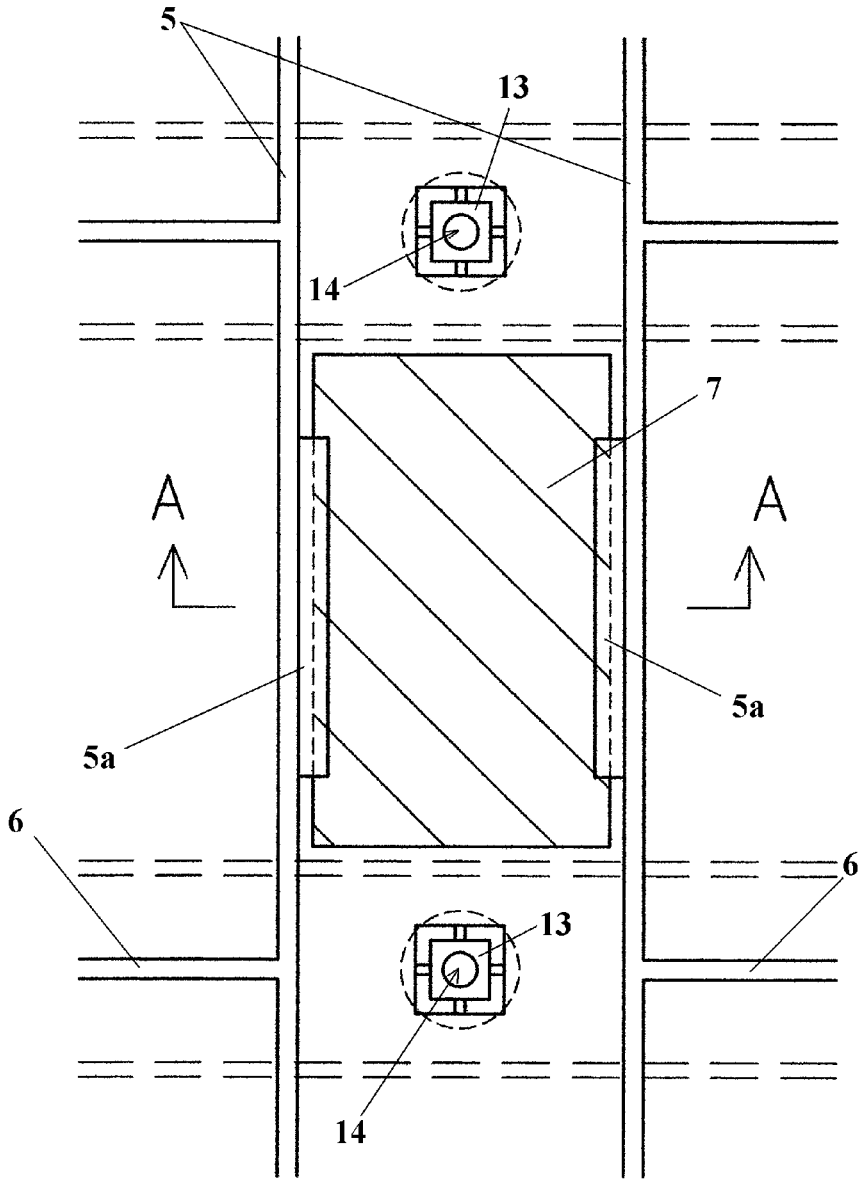
FIG. 8 is a plan view near a case according to the embodiment of the present invention.
Figure 9:
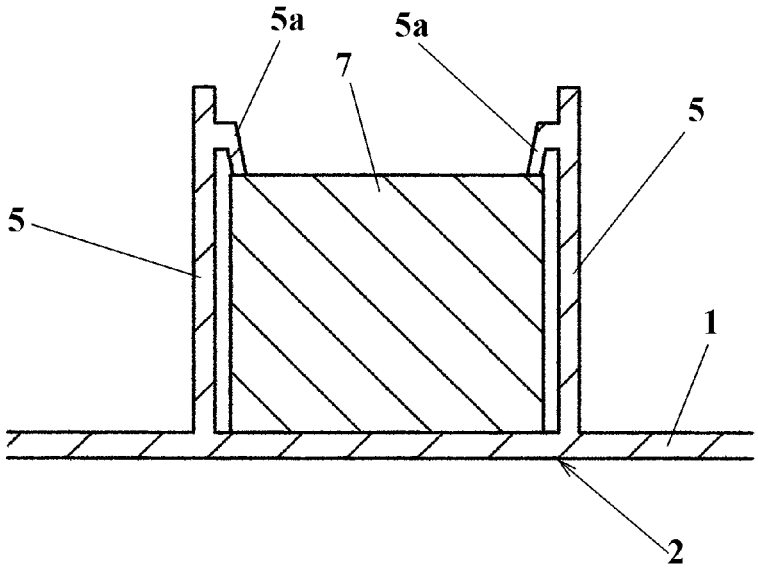
FIG. 9 is a sectional diagram of FIG. 8 taken at line A-A.

FIG. 8 is a plan showing the case according to the embodiment of the present invention, and FIG. 9 shows a sectional view taken along line A-A of FIG. 8. As illustrated in FIG. 8, the case 7 is housed in a space between long side reinforcing ribs 5 near a position where the square washer 13 with the temperature sensor is provided.

As shown in FIG. 9, engaging pawl 5*a* protrudes downward from an internal face of the long side reinforcing rib 5, and an end portion of the engaging pawl 5*a* presses downward an upper end of the case 7. In this way, the case 7 is pushed by the engaging pawl 5*a*, and thereby the case 7 is fixed to the main unit 1 of recyclable formwork without a nail and/or a peg.

Typically, the main unit 1 of recyclable formwork is composed of recyclable resin. However, the main unit 1 may be composed of aluminium, iron, or the like. Anyway, when the main unit 1 of recyclable formwork has been used and damaged to be recycled, the case 7 should be removed. This is because impurities will be contained if the formwork with the case 7 is recycled. In this case, the engaging pawl 5*a* may be destroyed using a suitable tool, and the case 7 may be removed.

With the layout as illustrated in FIG. 8, output signals from the temperature sensor near the case 7 can be inputted into a circuit in a case 7 with a cable. A number of signal-inputting paths to the circuit in the case 7 may be increased/decreased if needed. Usually, it is considered sufficient that the temperature of one point per one recyclable formwork is measured. However, two or more measurement points may be adapted.

Figure 10:
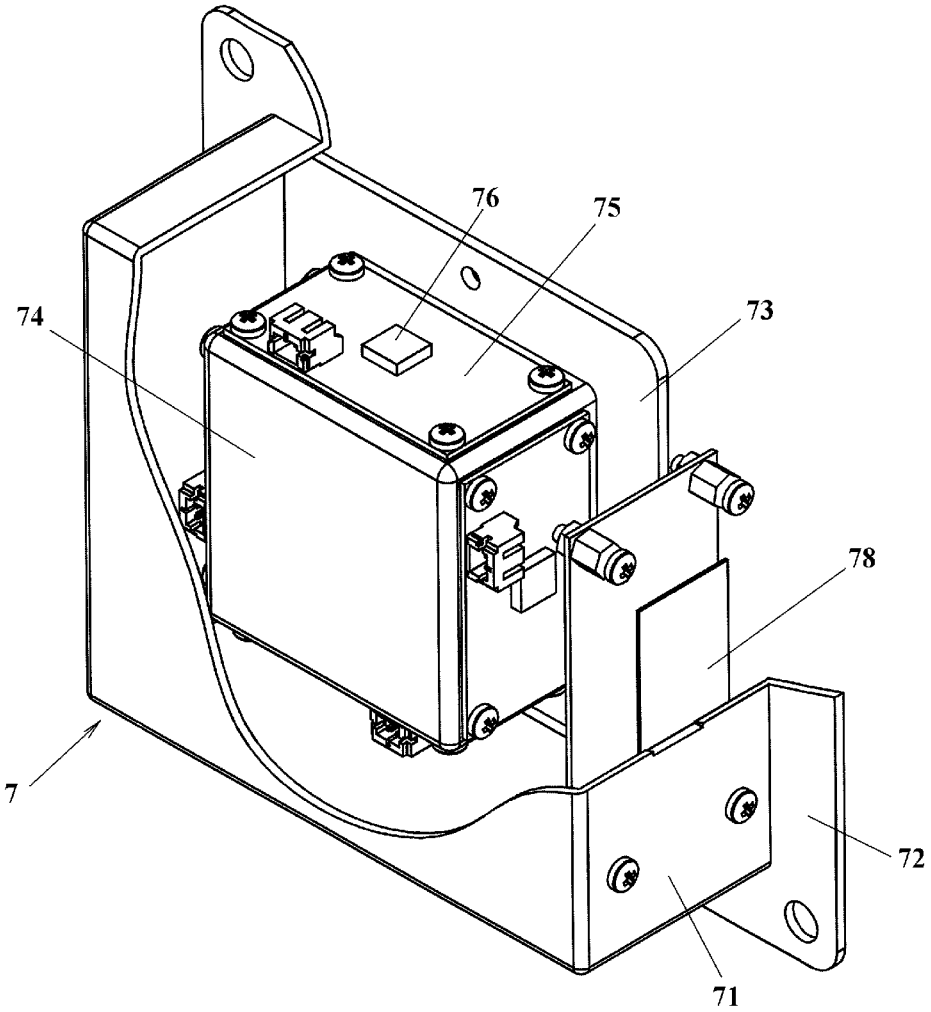
FIG. 10 is a perspective diagram showing the case according to the embodiment of the present invention.

Next, an example of configuring the case 7 will now be explained. FIG. 10 is a perspective view showing the case according to the embodiment of the present invention.

The case 7 surrounds all elements and includes: a cover 71 for protecting the interior of the case from rain water, or the like; and a flange 72 for making attachment of the case easy. A base plate 73 is fixed in the cover 71, and a substrate holder 74 adheres to the base plate 73.

Each face of the substrate holder 74 is oriented taking into consideration directions of the main unit 1 of recyclable formwork. A first substrate 75 on which an inclination sensor 76 has been mounted is provided with a predetermined face of the substrate holder 74. At a position separate from the substrate holder 74 in the cover 71, a second substrate 77 on which a communication circuit 78 has been mounted is arranged.

Needless to say, the configuration of FIG. 10 is a mere example, and various kinds of modification and/or changes can be made thereto.

The recyclable formworks according to the present invention are suitably used for managing use times of each recyclable formwork in a field where the recyclable formworks are lent. Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A recyclable formwork for use at an outdoor working site, comprising:

a main unit having a contact surface for contact with cast concrete, a non-contact surface that is parallel and opposite to the contact surface, and a plurality of ribs projecting from the non-contact surface in a direction away from the non-contact surface and reinforcing said main unit;

a case housed between the plurality of ribs and fixed on said main unit on a non-contact surface side of said main unit;

a circuit in said case;

a separator extending through a hole in said main unit so as to directly contact the cast concrete and remain within the cast concrete after the cast concrete has hardened;

a temperature sensor on said main unit so that said temperature sensor is in thermal contact with said separator so as to be in thermal contact with the concrete cast on the contact surface and so as to measure changes of temperature of the concrete cast on the contact surface and send temperature signals to said circuit in said case, and so that said temperature sensor does not directly contact the cast concrete.

2. The recyclable formwork of claim 1, wherein:

the circuit includes an inclination sensor for measuring inclination of the recyclable formwork; and a point of the case that is furthest away from the non-contact surface is not further away from the non-contact surface than a point furthest away from the non-contact surface of upper ends of the plurality of ribs.

3. A recyclable formwork for use in an outdoor working site, comprising:

a formwork unit having a contact surface for contact with cast concrete, a non-contact surface that is parallel and opposite to the contact surface, and a plurality of ribs projecting from the non-contact surface in a direction away from the non-contact surface and reinforcing the formwork unit;

a case housed between the plurality of ribs and fixed on the formwork unit on a non-contact surface side of said formwork unit;

a circuit in said case;

a separator extending through a hole in said main unit so as to directly contact the cast concrete and remain within the cast concrete after the cast concrete has hardened;

a temperature sensor on the non-contact surface side of said formwork unit so that said temperature sensor is in thermal contact with said separator so as to be in thermal contact with the concrete cast on the contact surface, so that said temperature sensor measures changes of temperature of the concrete cast on the contact surface and sends temperature signals to said circuit in said case, and so that said temperature sensor does not directly contact the cast concrete.

4. The recyclable formwork of claim 3, wherein:

the circuit includes an inclination sensor for measuring inclination of the recyclable formwork; and a point of the case that is furthest away from the non-contact surface is not further away from the non-contact surface than a point furthest away from the non-contact surface of upper ends of the plurality of ribs.

5. The recyclable formwork of claim 3, wherein said temperature sensor comprises a thermistor thermally connected and united with a square washer, and the square washer has a through hole aligned with a said hole in said formwork unit.

6. A recyclable formwork for use in casting concrete at an outdoor working site, comprising:

a main unit having a contact surface for contacting cast concrete, a non-contact surface that is on an opposite side of said main unit from said contact surface and parallel to said contact surface so that said main unit has a contact surface side for contacting concrete and a non-contact surface side, and a plurality of ribs that project from the non-contact surface in a direction away from the non-contact surface and that reinforce said main unit;

a case that is housed between said plurality of ribs and that is fixed on said main unit on the non-contact surface side thereof, said case housing a circuit therein;

a separator extending through a hole in said main unit so as to directly contact the cast concrete and remain within the cast concrete after the cast concrete has hardened;

a temperature sensor on said main unit so that said temperature sensor is in thermal contact with said contact member so as to be in thermal contact with the concrete cast on the contact surface, so that said temperature sensor measures changes of temperature of the concrete cast on the contact surface and sends temperature signals to said circuit in said case, and so that said temperature sensor does not directly contact the cast concrete.

7. The recyclable formwork of claim 6, wherein:

said separator extends from the non-contact surface side of said main unit to the contact surface side; and said temperature sensor is on the non-contact surface side of said main unit.

8. The recyclable formwork of claim 7, wherein said temperature sensor is connected to a washer surrounding and in direct contact with said contact member.

* * * * *